United States Patent [19]

Weiss

[11] Patent Number: 5,000,234

[45] Date of Patent: Mar. 19, 1991

[54] METHOD FOR FILLING CANS

[75] Inventor: Wilhelm Weiss, Lappersdorf, Fed. Rep. of Germany

[73] Assignee: Krones AG Hermann Kronseder Maschinenfabrik, Neutraubling, Fed. Rep. of Germany

[21] Appl. No.: 424,618

[22] Filed: Oct. 20, 1989

[30] Foreign Application Priority Data

Oct. 26, 1988 [DE] Fed. Rep. of Germany ..... 3836489

[51] Int. Cl.[5] ..... B65B 31/00

[52] U.S. Cl. ..... 141/6.00; 141/40; 141/48; 141/51

[58] Field of Search ..... 141/6, 39, 40, 4, 5, 141/7, 47, 48, 49, 51, 52, 63, 92

[56] References Cited

U.S. PATENT DOCUMENTS

| | | | |
|---|---|---|---|
| 3,212,537 | 10/1965 | Hinxlage et al. | 141/6 |
| 3,380,488 | 4/1968 | Herbst | 141/63 |
| 3,834,428 | 9/1974 | Rademacher | 141/39 |
| 4,589,453 | 5/1986 | Weiss | 141/39 |
| 4,637,438 | 1/1987 | Weiss | 141/6 |
| 4,655,029 | 4/1987 | Weiss | 141/6 |
| 4,688,608 | 8/1987 | Puskarz et al. | 141/39 |
| 4,787,428 | 11/1988 | Bacroix et al. | 141/39 |

*Primary Examiner*—Henry J. Recla

*Assistant Examiner*—Keith Kupferschmid

*Attorney, Agent, or Firm*—Fuller, Ryan & Hohenfeldt

[57] ABSTRACT

In apparatus for filling cans with beverage the can is coupled to the filler valve and purged of atmospheric air with a mostly inert gas and air mixture derived from the space of the liquid in a storage tank. When the exhaust valve is closed, another valve opens to permit pure inert gas stored in a reservoir to flow into the can and pressurize it to slightly above atmospheric pressure but below the pressure in the storage tank. A pre-pressurization valve is then opened to let some of the inert gas and air mixture in the storage tank flow to the can which is occupied by the substantially pure inert gas so practically none of the downflowing gas and air mixture from the storage tank enters the can although it fills the chamber to which the can is connected and thereby pressurizes the can. When the can pressure and storage tank pressure become equal, a liquid control valve opens to drain liquid from the tank into the can. Liquid flow is shut off in a conventional manner when the liquid level in the can reaches the lower tip of the pre-pressurizing gas return tube. As the liquid beverage flows into the can it displaces the most pure inert gas into the space above the liquid in the storage tank so as to increase the concentration of the inert gas in the storage tank.

6 Claims, 7 Drawing Sheets

METHOD FOR FILLING CANS

BACKGROUND OF THE INVENTION

The invention disclosed herein relates to a method and apparatus for filling beverage cans in which the cans are pre-pressurized with an inert gas before being filled with a beverage drawn from a tank which is pressurized with an inert gas.

It is known that to prevent premature spoilage and a change in the taste characteristics of a beverage in a can, the amount of air remaining in a can after it is filled with a beverage must be minimized. When filling a beverage can, therefore, it is common practice to evacuate the can and then pre-pressurize it with an inert gas before filling it with the beverage. Evacuating, pre-pressurizing and filling a can is not a straight forward procedure, however, because special precautions must be taken to avoid having the thin wall of the can deformed by the pressure differential between the inside of the can and the atmosphere.

A can filling method which has been in use recent years provides that an inert gas such as $CO_2$ be admitted to the can through a differential pressure chamber whereupon the can is pre-pressurized to a pressure below that of the pressure of the gas which exists above the beverage in the storage tank. The final pre-pressurization takes place through a connection established to the inner atmosphere of the tank by means of the tube in the center of the filler valve which is otherwise known as the gas return line. The disadvantage of this method is that during pre-pressurization of the can with $CO_2$ gas, the air previously located in the can remains there. In other words, the air in the can is at first diluted with $CO_2$ gas. It is therefore not possible with this method to achieve a low air concentration in the can. The proportion of air in the can is even higher than that in the storage tank. Since the inert gas and air mixture is passed from the inside of the can into the tank during the can filling procedure, the inert gas in the tank becomes more and more diluted with air.

In another can filling machine which is in current use, the inside of the can is flushed or purged prior to being filled with the $CO_2$ and air mixture derived from the atmosphere of the storage tank. Next, since the can is sealed to the filler valve, it is pre-pressurized with the gas and $CO_2$ mixture derived from the storage tank through the above mentioned gas return line. Even with very high $CO_2$ concentration on the inside of the storage tank, it is barely possible to achieve with this method a $CO_2$ concentration of more than 80% in the can.

SUMMARY OF THE INVENTION

The objective of the can filling method and apparatus disclosed herein is to improve the concentration of $CO_2$ gas in the can before it is filled with the liquid beverage without consumption of excessive quantities of inert gas. According to the invention, the can and filler valve chambers are flushed with $CO_2$ gas with some air mixed in it as derived from the space in tank 3 above the liquid 4. This initial charge from the tank does not pressurize the can since a relief or flush valve opens at this time to let the $CO_2$ gas and air mixture flush into the atmosphere. After the can is purged of much of its air by this step, the flush valve closes and the pressure inside of the can rises to the pressure $P_k$, which exists above the liquid 4 in the storage tank 3.

After the can is pressurized to the pressure in storage tank 3, a valve is opened which allows flow of pure $CO_2$ from a source in the form of reservoir 18 into the can to displace the $CO_2$ and air mixture which presently exists in the can with pure $CO_2$. At this time the relief valve is opened to permit the $CO_2$ and air mixture to discharge to the atmosphere. The pressure from gas from the reservoir which is fed into the can before filling it with liquid is slightly lower than the pressure existing in the storage tank so there is some flow of the $CO_2$ and air mixture from the storage tank to the inside of the can which results in the pressure inside of the can increasing slightly to become equilibrated with the pressure in the storage tank 3.

When the pressure in the can and the tank become equal, liquid begins to flow from the tank into the can so as to displace the nearly pure $CO_2$ which is in the can into the storage tank in which case the concentration of $CO_2$ in the storage tank improves, instead of being more diluted as in the prior art, with each can that is filled. As is typical of filler valves, when the liquid level in the can reaches and seals off the lower tip of the gas return tube, liquid flow is automatically cut off. A snifter or relief valve is then opened so that the gas pressure on top of the liquid in the can is relieved to atmospheric pressure before the can is disconnected from the filler valve.

According to the new method, the concentration of air in the cans can be reduced to less than 5% of the gas in the can. The method is simple. Aside from the initial flushing of the can, the procedure most importantly takes advantage of the fact that the inert gas and air mixture existing in the can after flushing with gas from the tank is displaced into a differential pressure chamber. Thus, after the pure inert gas from the source is admitted to the can a much lower concentration of air exists inside of the can than in the differential pressure chamber. Since the concentration of air in the can is now also lower than the concentration of air on the inside of the storage tank, every can, whose interior gas is displaced into the tank by liquid admitted to the tank, improves the atmosphere inside of the storage tank since a gas mixture with the higher $CO_2$ content flows into the tank than from the tank. The beneficial effect is essentially achieved because the pure inert gas from the source does not pass through the differential pressure chamber on its way to the can as may be the case in prior art filler valves, but rather passes in a directly preferred manner through the gas return line into the can, whereby the gas mixture is permitted to shunt the differential pressure chamber. Since the proportion of air inside of the storage tank continually decreases, it is better, for the purpose of saving inert gas, to flush the air out of the can with gas derived from the storage tank before the can is pre-pressurized with the pure inert gas. If, however, it is desirable to have practically no air remain on the inside of the can, the can can also be flushed with pure inert gas.

It has been demonstrated to be beneficial to have the can pre-pressurized with inert gas to a pressure of approximately 0.2 to 0.5 bar below that of the inside of the storage tank 3.

Insofar as the structure is concerned, it is particularly easy to arrange the inert gas valve between the pre-pressurization valve and the filling unit. In order to improve the flushing efficiency of the can prior to pre-pressurizing with inert gas, the flush channel can be connected to vacuum pump, but care must be taken that only a very low negative pressure is developed in the can in order to avoid deformation in the can by atmospheric pressure.

An illustrative embodiment of the invention will now be described in more detail in reference to the drawings.

DESCRIPTION OF THE PREFERRED EMBODIMENT

Figure 1:
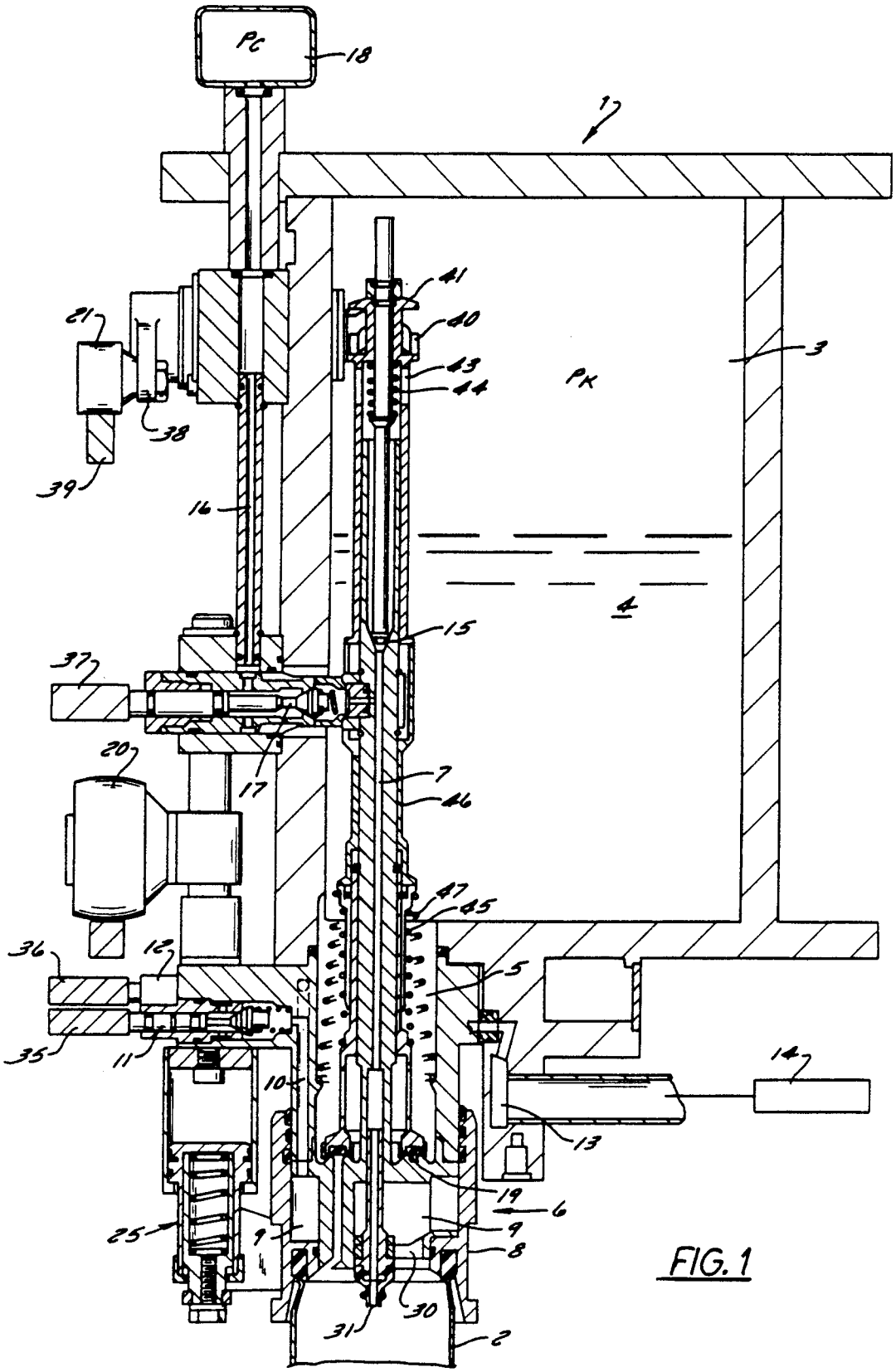
FIG. 1 is a schematic vertical cross sectional view of the can filling apparatus embodying the invention.

In FIG. 1, apparatus 1 for filling a beverage can 2 with a filler valve 6 using a counterpressure method is illustrated. Some of the features of the filler valve are known. The apparatus includes an annular or toroidal tank 3 which is partially filled with a liquid beverage 4 over which there is an inert gas such as a carbon dioxide and air mixture at a pressure $P_k$ which, for example, is desirably about two bars higher than atmospheric pressure. The gas in the tank 3 above the liquid level is a mixture of mostly carbon dioxide ($CO_2$) and air. From the bottom of the annular tank 3 a filler valve 6 extends downwardly and includes a cylindrical sealing sleeve 8 which lowers onto the top of the can 2 and forms a fluid tight seal as soon as the can is aligned with the filler valve. Sleeve 8 is driven up and down by a known type of pneumatic operator 25.

Figure 1B:
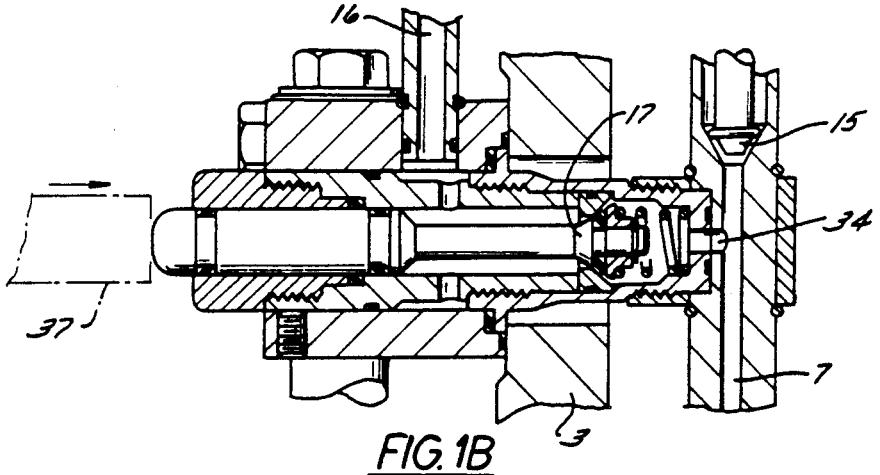
FIG. 1B is an enlargement of that part of the filler valve shown in FIG. 1 which includes the horizontally arranged can operated valve that allows flow of the inert gas, which contains no air, into the can and also includes the valve which controls the flow of air diluted can flushing gas to and from the liquid storage tank.

A tubular gas return line 7 leads from the space above the liquid level in tank 3 concentrically through a channel 5 and through the sealing sleeve 8 to the inside of can 2. The lowermost tip 31 of gas return tube 7 automatically determines the highest level of fill within the beverage can as is typical of counterpressure filling valves. A valve 15 is arranged in the gas return line 7 to control the flow of $CO_2$ and air mixture from storage tank 3 into the beverage can 2 and also to control the flow of concentrated inert gas from the can into the storage tank when the can is being filled with liquid later. This valve is used for flushing the can of air and prepressurizing the can with gas derived from storage tank 3. There is a reservoir 18 which contains $CO_2$ at a pressure $P_c$, which is slightly lower than the pressure, $P_k$ existing in storage tank 3. By way of example, $P_c$ may be about 0.2 to 0.5 bar lower than $P_k$ and $P_k$ may be about 2 bar higher than atmospheric pressure. Immediately below pre-pressurization valve 15 there is a valve 17 which places the gas return line 7 in communication with a pure $CO_2$ source in the form of reservoir 18 by means of a tubular passageway 16. The enlarged view of valve 16 in FIG. 1B makes it clear that the discharge port 34 of the valve connects to the gas return line 7 below the seat of valve 15 so pure inert gas can flow at an appropriate time into a can during a can filling cycle and can bypass gas return line valve 15 which is closed when valve 17 opens to let gas flow from the reservoir 18. Valve 17 is opened when it encounters a cam 37 at an appropriate time in a can filling cycle.

Figure 1A:
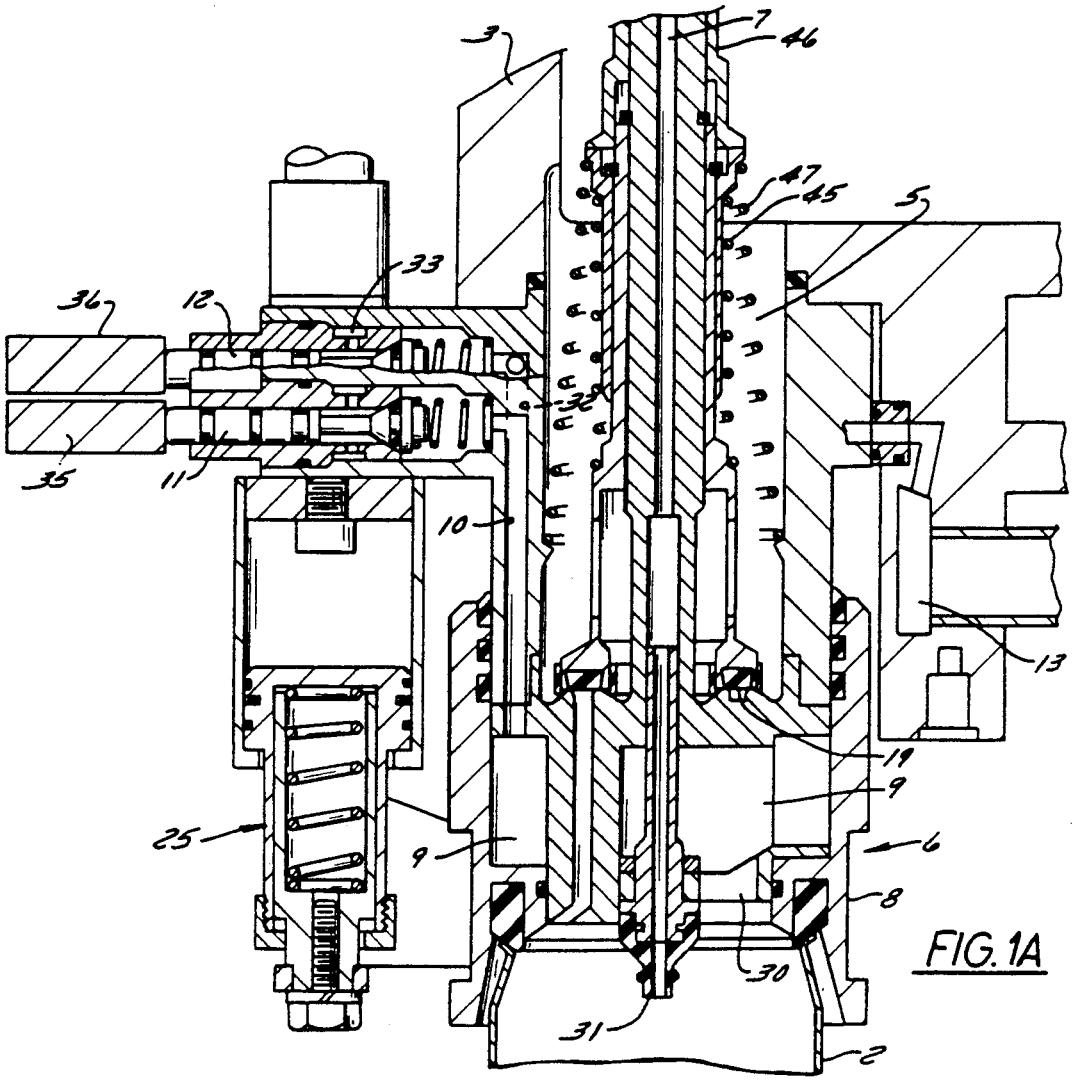
FIG. 1A is an enlargement of approximately the lower half of the filler valve shown in FIG. 1.

A differential pressure chamber 9 is formed in the filler valve above the mouth of the can. This sealing sleeve is driven by a pneumatic operator 25 which is a known expedient. Chamber 9 is in communication with the inside of beverage can 2 by way of an opening 30. A channel 10 leads out of the differential pressure chamber 9 to a flush valve 11 which relieves gas to the atmosphere and a relief valve 12 which also discharges gas to the atmosphere for equilibrating the inside of the can with the atmosphere just prior to the can being disconnected from the sealing sleeve 8. As can be seen most clearly in FIG. 1A, channel 10 has a continuation channel 32 that leads to relief valve 12 which is located behind the flush valve 11. The relief valve 12 is involved in the last step of a can filling cycle which is to open and relieve the gas pressure in the can before it separates from sleeve 8. Thus, this gas is conducted by channels 10 and 32 through relief valve 12 for discharging to the atmosphere through a port 33. Flush valve 11 and relief valve 12 are opened when they encounter cams 35 and 36, respectively, at an appropriate time in a can filling cycle. The flush valve 11 only opens during flushing the air out of can 2 with the inert gas and air mixture from storage tank 3 prior to the can being pre-pressurized. During initial flushing of the can, the air purged out of the can can be drawn into a vacuum pump 14 but great care must be taken to avoid development of significant negative pressure in the can lest it collapse under the influence of atmospheric pressure. Using a vacuum pump provides for faster purging of the can.

The filler valve includes a spring biased conventional liquid filling valve 19 which automatically opens when the pressure inside of the can equilibrates with the pressure inside of annular tank 3. Liquid valve 19 is of the type widely used and need not be described in greater detail except to say that it permits, when opened, liquid 4 to flow downwardly from the tank toward and into can 2. In apparatus of this kind there are a number of filler valves arranged on the outer circumference of tank 3 so that a number of cans can be filled simultaneously.

The filler valve 6 of FIGS. 1–6 is operated by a swinging arm 38 on which there is a cam follower roller 21 which is driven by encountering and departing from a cam 39 at appropriate times in a filling cycle. The shaft, not visible, which is swung by arm 38 terminates in a fork 40 which acts on the filler valve by moving between a spool 41 which joins with a sleeve 42. There are holes 43 in sleeve 42 which allow bidirectional gas flow between tank 3 and gas return line 7. Gas return line valve 15 is normally biased closed by a spring 44. When cam roller 21 drives valve 15 open by means of fork 40 it also lifts sleeve 42 which, in turn, relieves the compressive force on a spring 45 which up to that time is holding liquid valve 19 soundly closed with a positive force. Now it is only a spring 47 which is holding liquid valve 19 closed. However, since gas return valve 15 is assumed to have been opened by fork 40, the air and gas mixture from tank 3 for initial flushing air from can 2, the gas pressure in the can is approaching the pressure in tank 3. As soon as equilibration occurs between the pressure, $P_k$, in the tank and the can, the low force applied by spring 47 is overcome and liquid valve 19 is lifted open. The can 2 fills with liquid until tip 31 of the gas return line becomes blocked by the rising liquid level. This stops liquid flow as is typical of counterpressure filler valves. Tank pressure is the only force available for closing the liquid valve at this time.

Figure 2:
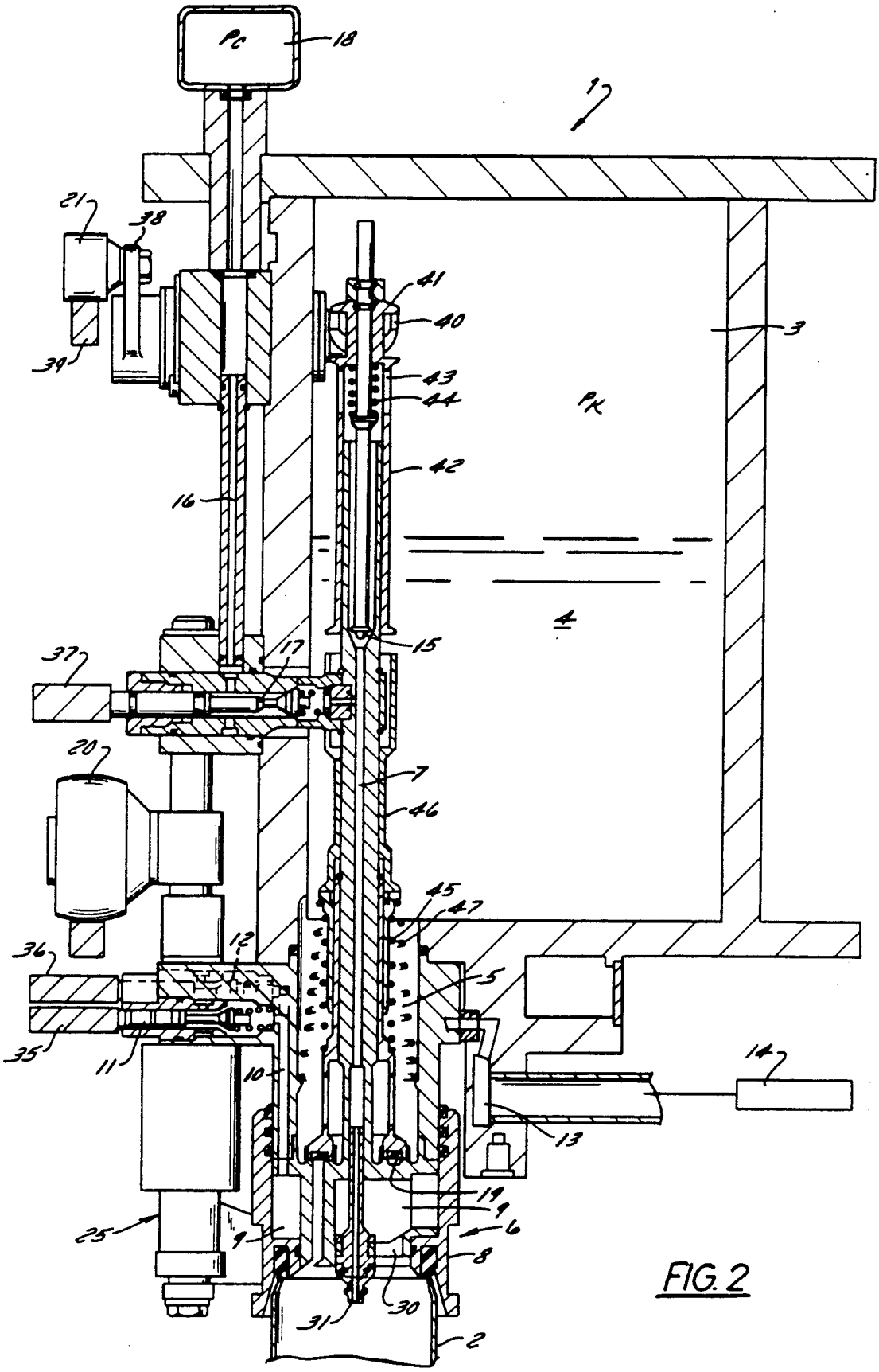
FIG. 2 shows conditions in the apparatus existing during flushing of the beverage can with gas derived from the liquid storage tank.

Now that the significant elements of the apparatus have been described, a more detailed description of the operating mode will be presented. After a beverage can 2 has been positioned under filler valve 6, the cylindrical sealing sleeve 8 is lowered under the influence of pneumatic operator 25. At this time the can is still filled with air at atmospheric pressure and the interior of the can is now in communication with differential pressure chamber 9 through opening 30. Next, valve 15 opens as does the flush or exhaust valve 11 so that carbon dioxide with some air mixed in it will flow from tank 3 into the can where it displaces the air which is discharged to the atmosphere to flush valve 11. What happens at this part of the filling cycle is illustrated in FIG. 2. The purging air and inert gas mixture from tank 3 passes down through gas return line 7 and through the open valve 15 and into the can after which it flows through the differential pressure chamber 9, channel 10, flush channel 13 and flush valve 11 into the atmosphere or alternatively in some embodiments to vacuum pump 14 which draws a vacuum that is just a little below atmospheric pressure. The air from beverage can 2 is thus flushed out and at least partially replaced by the $CO_2$ and air mixture from tank 3. Because flush valve 11 has been opened, the inside of the can 2 is near atmospheric pressure during purging. The $CO_2$ concentration in the annular tank 3 is typically about 95%. The concentration in can 2 is about 85% at the end of the flush procedure. The valve operations mentioned are controlled by cam followers 20 and 21 which are driven by annular cams, not shown, which are of a type familiar to filler valve system designers.

Figure 3:
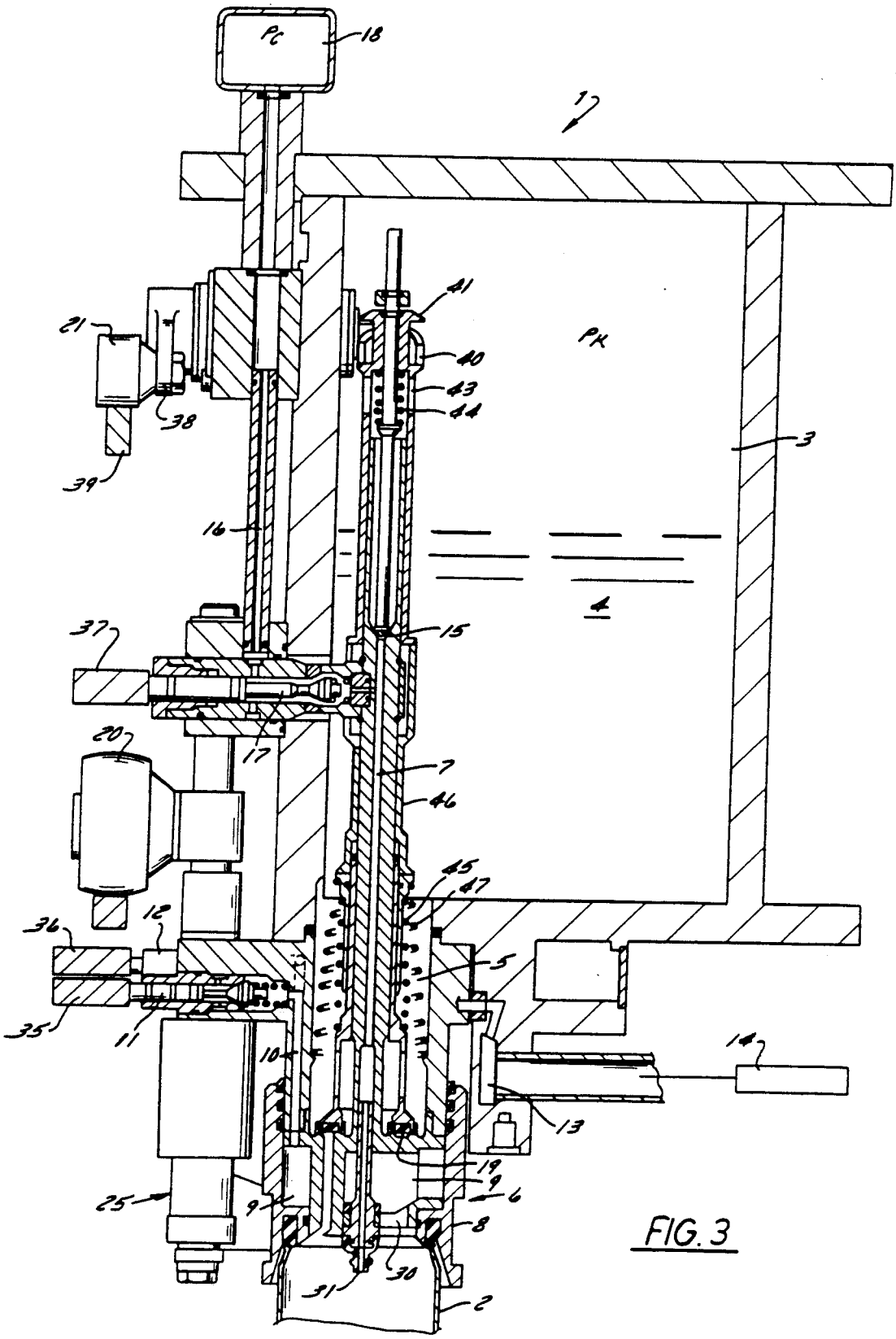
FIG. 3 shows the apparatus in the condition existing during pre-pressurization of the can.
Figure 4:
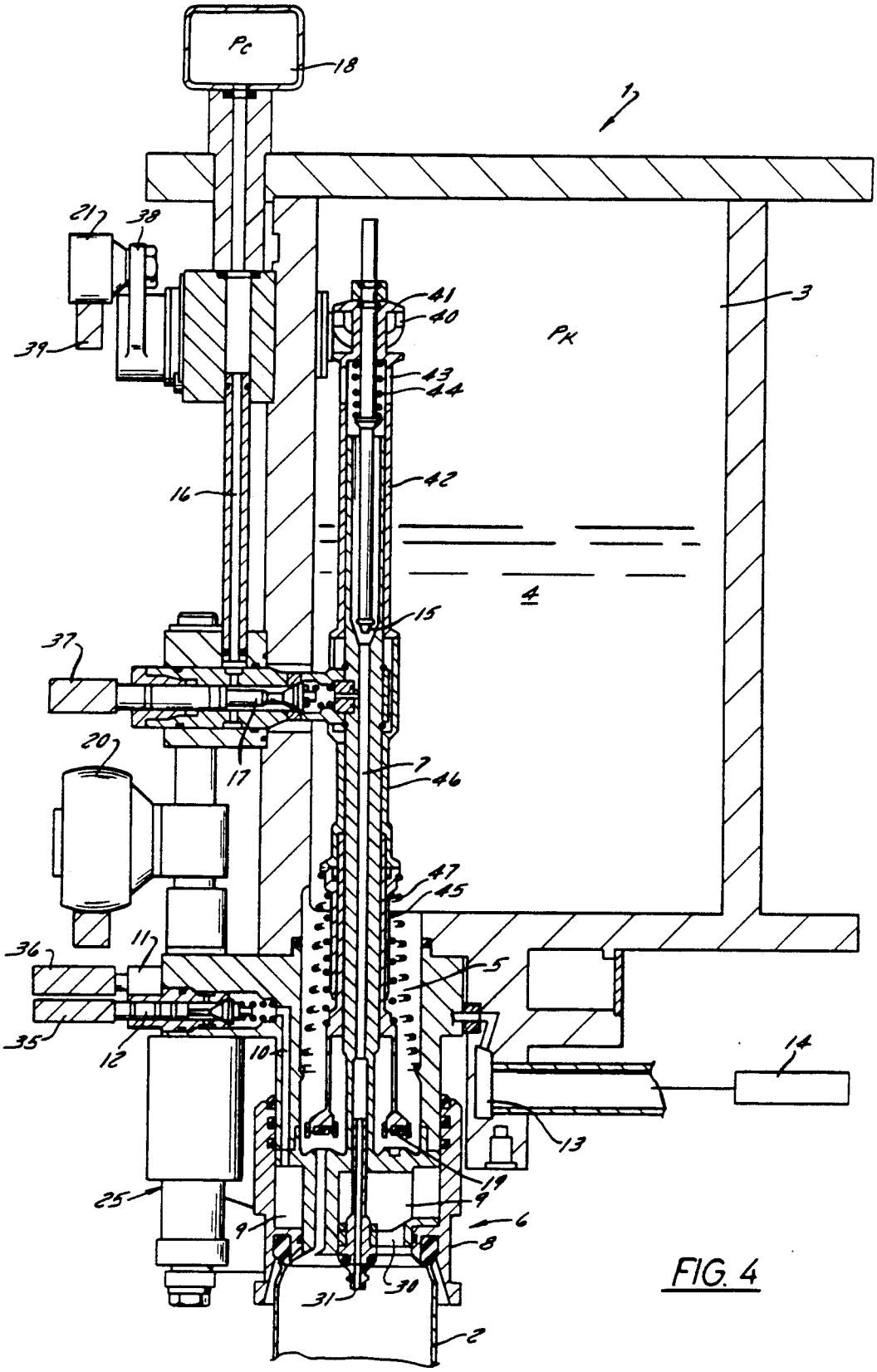
FIG. 4 shows the apparatus during continuing pre-pressurization.
Figure 5:
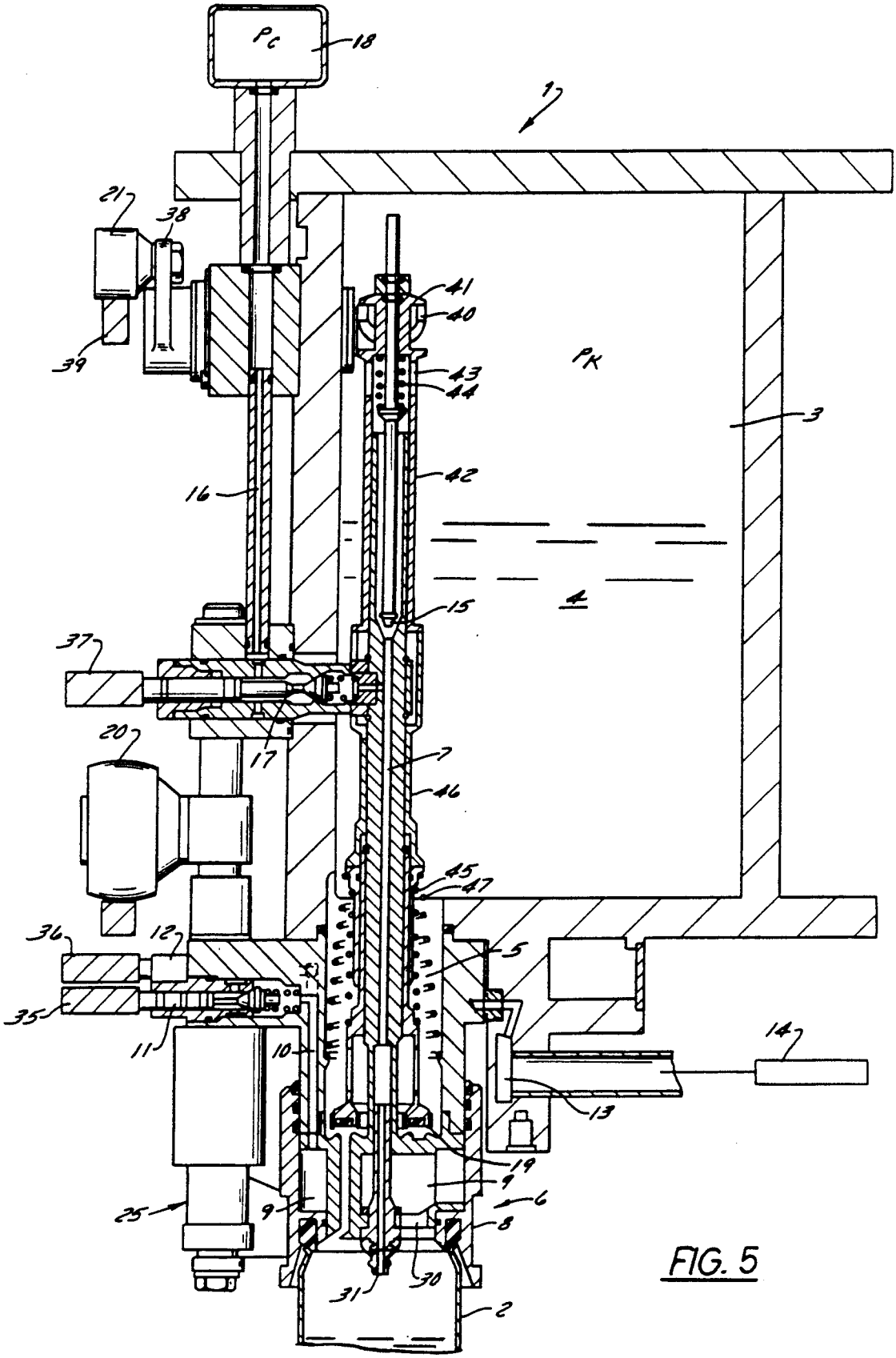
FIG. 5 shows the apparatus during filling of the can with a beverage.

After the valve 15 and the flushing valve 11 are closed, valve 17 opens as is the situation which exists in FIG. 3. Opening of valve 17 allows $CO_2$ at a pressure of $P_c$, which is above atmospheric pressure, to flow from the $CO_2$ gas container 18 through tube 16, gas valve 17 and the lower part of gas return line 7 and into the can 2. The $CO_2$ and air mixture present in the beverage can 2 at this time is compressed by the higher than atmospheric pressure pure $CO_2$ and, most of the gas from the can is displaced into differential chamber 9 so that the beverage can contains a high proportion of $CO_2$. Now the interior of the can is at reservoir 18 pressure $P_c$. After closing the valve 17 which feeds the pure inert gas to the can, the pre-pressurization valve 15 is opened again so that a pressure equilibration between annular tank 3 and the inside of can 2 is established as is the case in FIG. 4.

Since the difference between the pressure $P_k$ in tank 3 and the pressure $P_c$ from pure $CO_2$ reservoir 18 which existed earlier on the inside of the can is only slight, only very little of the $CO_2$ air mixture from tank 3 flows into the inside of the beverage can 2. Thus, the proportion of $CO_2$ in the can does not decline. In fact, the $CO_2$ concentration in the can is over 95% following the final pre-pressurization resulting from opening of valve 15 with all other exhaust ports closed.

Figure 6:
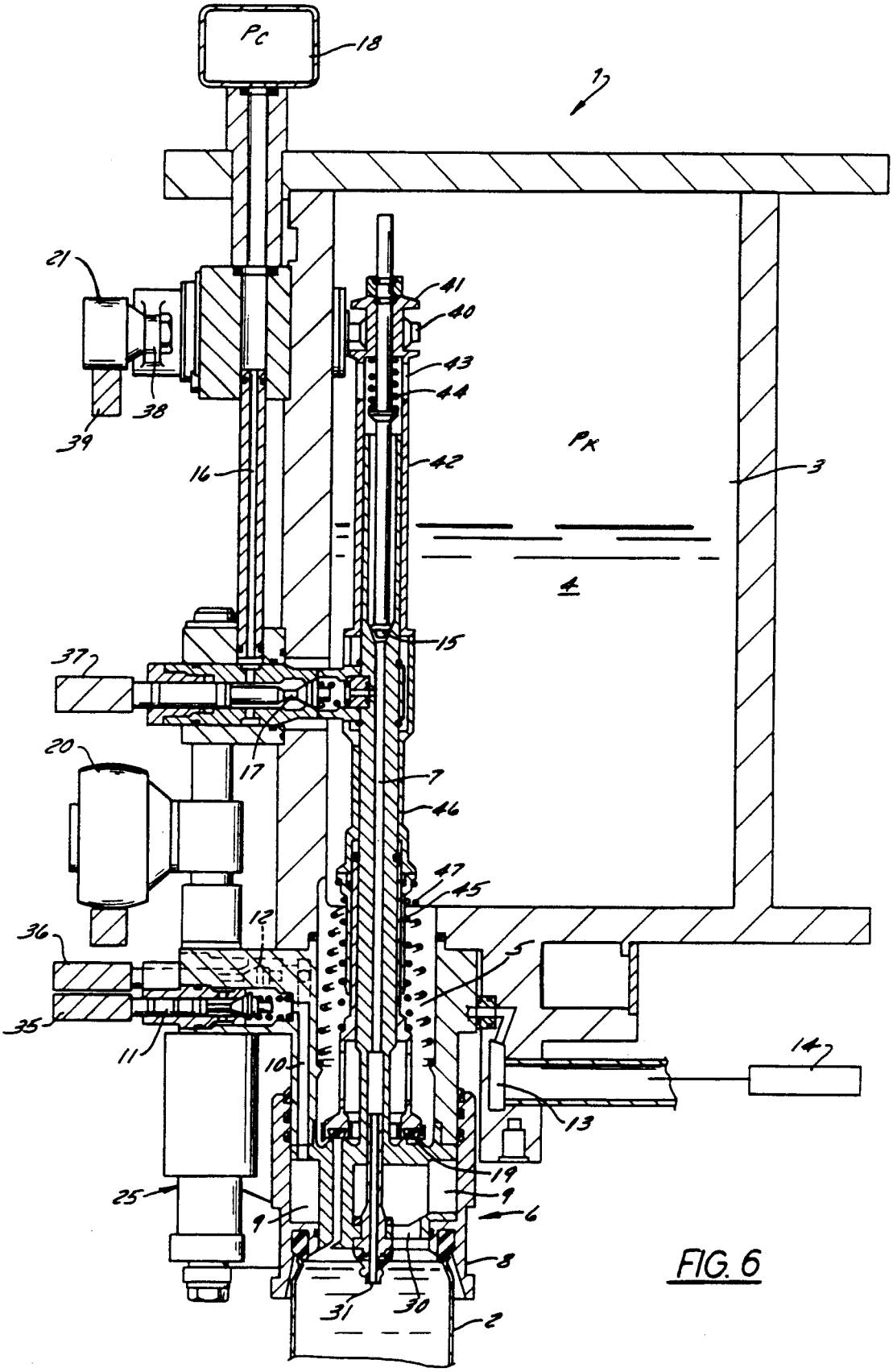
FIG. 6 shows the apparatus during relieving the gas pressure in beverage can just before the can is disconnected from the filler valve.

As soon as the pressure in the can becomes equal to the pre-pressurizing gas pressure $P_k$, the liquid control valve 19 opens to permit beverage to flow from the quantity stored in tank 3 into can 2. The gas pressure, $P_c$, in the can becomes equal to the tank pressure $P_k$ because, as stated above, the pre-pressurization valve 15 has been opened again. Gas can only back flow from the can 2 to the tank 3 until the pressure is equalized. Because the volume of gas in can 2 and chamber 9 is very small compared to the volume in the tank 3 which is hundreds of times greater than the can and chamber volume together, there is no easily measurable addition to the tank pressure. Moreover, in counterpressure filling machines the gas pressure $P_k$ is held constant by a pressure regulating valve, not shown, as is well known to those involved in this art. The highly concentrated $CO_2$ atmosphere inside of the beverage can now is displaced through the gas return line 7 and 15 into annular tank 3 which results in a continuing improvement in the proportion of $CO_2$ in tank 3. After filling the beverage can 2 with liquid, the liquid filling valve 19 and the pre-pressurization valve 15 are automatically closed. As shown in FIGURE 6, when the liquid level in the can reaches the lower tip 31 of gas return tube 7, the liquid closes off the tip and the unit responds by automatically closing the spring biased liquid control valve 19. Upon this event, there is a small amount of essentially pure $CO_2$ remaining in the can at pressure $P_k$. When liquid control valve 19 closes, the relief valve 12, which is sometimes called a snifter valve, opens and the pressure existing in the can and differential pressure chamber 9 escapes into the atmosphere and reduces the pressure in the can to atmospheric pressure. In the liquid filling process, however, the gas mixture containing almost pure $CO_2$ in the can goes back into tank 3 to enrich it with $CO_2$.

From the description set forth above, it is clear that with the apparatus and method according to the invention, the highest $CO_2$ concentration is achieved in the area where it is needed, that is, in beverage can 2. Only the $CO_2$ and air mixture with a relatively small $CO_2$ proportion escapes into the atmosphere. The new method and apparatus achieve not only a decrease in the proportion of air in the can but also a concurrent saving of $CO_2$.

Although the new method described herein permits the creation of a $CO_2$ concentration of over 95% in the can, it is also an alternative to carry out the initial air flushing step as described in reference to FIG. 2 with pure $CO_2$ gas rather than with the inert gas and air mixture from the tank if the ultimate in inert gas concentration above the liquid in the sealed can is desired.

I claim:

1. A method of filling cans with liquid comprising the steps of:

flushing air out of a can with an inert gas and air mixture derived from a tank containing said liquid and the gas mixture, flushing the mixture out of the can with undiluted inert gas at a pressure slightly lower than the pressure of the gas in the tank, isolating said can from the atmosphere and then filling the can with liquid flowed into the can from the tank while at the same time maintaining a gas flow path from the can to the mixture in the tank for the liquid to displace the inert gas into the tank.

2. The method according to claim 1 wherein the pressure of the inert gas is about 0.2 bar to 0.5 bar lower than the pressure of the gas mixture in the tank.

3. The method according to claim 2 wherein the mixture pressure in the tank is about 2 bar higher than atmospheric pressure.

4. A method of filling cans with liquid comprising the steps of:

coupling a can sealingly to a filler valve, storing the liquid in a tank and having a gas mixture of mostly inert gas and some air at a pressure $P_k$ in a space in the tank above the liquid, feeding said inert gas containing mixture from the tank to the inside of the can to displace and exhaust air from the can to atmospheric pressure, terminating feeding the gas mixture and exhausting of the air at which time the interior of the can is at atmospheric pressure and then opening a valve to couple the can to a source of pure inert gas at a source pressure of $P_c$ higher than atmospheric pressure but slightly lower than $P_k$, closing said valve to isolate said can from said source and resuming feeding of said gas mixture from said tank to the can to begin pre-pressurizing the can to the pressure $P_k$ of the gas in the tank, when the gas pressures in the tank and can equilibrate, causing said liquid to begin flowing through said filler valve from the tank to the can while having the inside of the can in communication with the gas in the space above the liquid in the tank for the substantially pure gas in the can to be forced by the incoming liquid into the tank, then isolating the can from the tank and uncoupling the can from the filler unit.

5. The method according to claim 4 wherein the pressure of the inert gas is about 0.2 bar to 0.5 bar lower than the pressure of the gas mixture in the tank.

6. The method according to claim 4 wherein the pressure of the inert gas and air mixture in the tank is about 2 bar above atmospheric pressure.

* * * * *